US006384731B1

(12) United States Patent
Sutherland

(10) Patent No.: US 6,384,731 B1
(45) Date of Patent: May 7, 2002

(54) SYSTEM FOR DETECTING A FIRE EVENT

(76) Inventor: Ronald L. Sutherland, P.O. Box 1633, Lawrence, KS (US) 66044

( * ) Notice: Subject to any disclaimer, the term of this patent is extended or adjusted under 35 U.S.C. 154(b) by 0 days.

(21) Appl. No.: 09/789,252

(22) Filed: Feb. 20, 2001

(51) Int. Cl.[7] ..... G08B 17/12

(52) U.S. Cl. ..... 340/577; 340/590; 340/596; 374/110; 338/26

(58) Field of Search ..... 340/577, 507, 340/518, 521, 596, 590, 584; 374/110, 183; 338/26

(56) References Cited

U.S. PATENT DOCUMENTS

| | | | | | |
|---|---|---|---|---|---|
| 3,774,184 | A | | 11/1973 | Scarelli | 340/596 |
| 4,157,526 | A | | 6/1979 | Davies | 374/183 |
| 4,175,437 | A | | 11/1979 | Burt | 340/584 |
| 4,628,301 | A | | 12/1986 | Brown et al. | 340/596 |
| 4,763,113 | A | | 8/1988 | Sassier | 340/596 |
| 4,814,766 | A | * | 3/1989 | Domingue | 340/590 |
| 5,185,594 | A | | 2/1993 | DeChurch | 340/584 |
| 5,412,374 | A | | 5/1995 | Clinton | 340/596 |
| 5,655,840 | A | | 8/1997 | Powell | 337/415 |
| 5,793,293 | A | | 8/1998 | Melamud et al. | 340/590 |
| 5,896,082 | A | * | 4/1999 | MacFarlane | 340/286.05 |
| 6,326,598 | B1 | * | 12/2001 | Carvalho et al. | 219/505 |

* cited by examiner

*Primary Examiner*—Edward Lefkowitz
*Assistant Examiner*—Davetta W. Goins
(74) *Attorney, Agent, or Firm*—Dale J. Ream

(57) ABSTRACT

A fire event detection system includes a programmable logic circuit which evaluates electrical resistance input data and energizes an alarm upon programmed conditions. The system includes a temperature sensitive polymeric tape spanning between a pair of conductors connected to the circuit. The conductors and tape define a plurality of notches for redirecting current transversely across the tape between the for enhancing responsiveness to a temperature increase at a particular location along the tape. The circuit energizes the alarm if the resistance data indicates a temperature greater than a predetermined critical temperature parameter or if the data indicates a temperature rate of rise greater than a critical rate of rise parameter. The tape may include notched and unnotched portions such that the circuit energizes the alarm if the rate of rise at a particular location is greater than the rate of rise of the tape as a whole.

20 Claims, 7 Drawing Sheets

SYSTEM FOR DETECTING A FIRE EVENT

BACKGROUND OF THE INVENTION

This invention relates generally to fire event sensing devices and, more particularly, to a system for more quickly sensing a critical temperature or a critical increase in temperature at any location within a monitoring area.

The use of various types of alarms for sensing fire event indicators such as heat or smoke are known. However, these devices include smoke or heat sensors disposed within a housing mounted on a wall or ceiling. An alarm is not sounded until sufficient amounts of smoke or heat reach the sensing device—a time delay which may allow a fire to advance significantly and to decrease the available time for occupants of the dwelling to escape. The rapidity with which a fire advances makes fast detection and response to a fire event of crucial importance.

Various devices have been proposed for evaluating the electrical characteristics of wires or cables extending between multiple fire event sensors, such as the system disclosed in U.S. Pat. No. 3,821,734 to Herrliberg, et. al. This system, however, still uses individual sensors positioned in spaced apart locations. The device proposed in U.S. Pat. No. 4,361,799 to Lutz provides an over-temperature sensor including a positive temperature coefficient of resistance cable and capacitance elements to detect the presence of an over-temperature condition for the purpose of protecting mechanical equipment. While assumably effective for its intended purpose, the '799 device does not provide the fastest response to the presence of a critical temperature at any location within a monitoring area and does not sense temperature or resistance rates of rise indicative of a fire event.

Therefore, it is desirable to have a fire event detection system that provides a fast response to a predetermined temperature occurring at any single cell location along a continuous path in a monitoring area. Further, it is desirable to have a system that energizes an alarm if a temperature rate of rise at any single cell location within the monitoring area exceeds a critical rate of rise parameter. It is also desirable to have a system which energizes an alarm if the resistance rate of rise at any single location is greater than the resistance rate of rise of the monitoring area as a whole.

SUMMARY OF THE INVENTION

A fire event detection system according to the present invention includes a programmable logic circuit capable of evaluating resistance input data supplied to it and comparing the evaluated data to various predetermined parameters. The system further includes a solid conductive positive temperature coefficient of resistance (PTCR) polymeric tape having opposed edges in contact with and enveloping respective conductors. The conductors have first and second ends electrically connected to the circuit. Therefore, the PTCR polymeric tape and conductors, also referred to collectively as "the sensor", extend in a generally U-shaped or fold-back configuration throughout a monitoring area such as a room of a house or an attic.

The edges of at least a portion of the sensor define a plurality of notches for repeatedly redirecting current transversely across the PTCR polymeric tape. Adjacent notches are spaced apart along opposed edges. In essence, this establishes a plurality of single sensing cells which sense resistance in series as opposed to sensing resistance in parallel as is the case with unnotched PTCR polymeric tape. Further, an increase in temperature at a particular cell has a greater effect on resistors configured in series than on resistors configured in parallel, making detection of a hot spot swifter using series resistors. The PTCR polymeric tape provides a sharp increase in resistance at a predetermined temperature. The conductors provide electrical resistance input data to the circuit for evaluation. The circuit energizes an alarm if the resistance data indicates a resistance greater than a critical resistance (i.e. the critical temperature has been exceeded). Further, the alarm is sounded if the evaluated resistance data indicates an average temperature rate of rise that is greater than a critical rate of rise. This condition indicates that a temperature increase in the monitoring area is not merely a natural climate change. Further, the circuit will energize the alarm if the resistance rate of rise of any single cell is greater than the resistance rate of rise of the unnotched portion of the PTCR polymeric tape. This indicates the existence of a hot spot, i.e. the temperature at one location is increasing faster than the temperature of the entire room or attic as a whole.

This invention is particularly well suited for use in an attic environment as the circuit evaluates whether increases in ambient air temperature are merely climate changes or whether the increases truly indicate the presence of a fire. However, the invention is also well-suited for use in traditional fire detection environments such as dwellings or businesses and provides a faster response to fire event indicators at any single cell location along the elongate sensor.

Therefore, a general object of this invention is to provide a fire event detection system that responds quickly to fire event indicators occurring at any single cell location in a monitoring area.

Another object of this invention is to provide a system, as aforesaid, which energizes an alarm if the temperature of a PTCR polymeric sensor exceeds a predetermined critical temperature.

Still another object of this invention is to provide a fire event detection system, as aforesaid, which energizes an alarm if the rate of rise of the average temperature of the sensor exceeds a critical rate of rise parameter.

Yet another object of this invention is to provide a fire event detection system, as aforesaid, which energizes an alarm if the temperature rate of rise of any single cell is greater than the rate of rise of the temperature of the unnotched portion.

A further object of this invention is to provide a fire event detection system, as aforesaid, which includes an elongate PTCR polymeric tape that extends throughout a monitoring area.

A still further object of this invention is to provide a fire event detection system, as aforesaid, in which the polymeric tape includes a plurality of resistance sensing cells configured in series rather than in parallel.

Another object of this invention is to provide a fire event detection system, as aforesaid, that is easy and economical to manufacture.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

A fire event detection system according to a preferred embodiment of the present invention will now be described in detail with reference to FIGS. 1 through 8 of the accompanying drawings.

Figure 9:
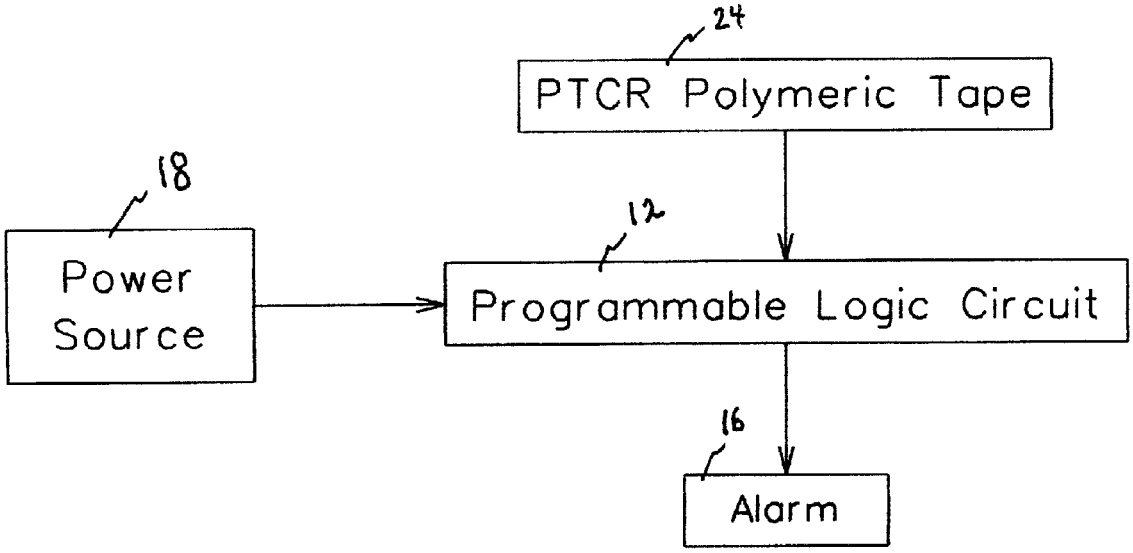
FIG. 9 is a block diagram of the fire detection system showing the major components thereof.

A fire event detection system 10 includes a programmable logic circuit 12 capable of evaluating resistance input data supplied to it and comparing the evaluated data to various predetermined parameters. Some of the evaluations, however, may be performed with a circuit 12 that is not programmable. The logic circuit 12 is positioned within a housing 14 along with a battery power source 18 and an alarm 16, the circuit 12 and alarm 16 being electrically connected to the power source 18 (FIG. 9).

Figure 1:
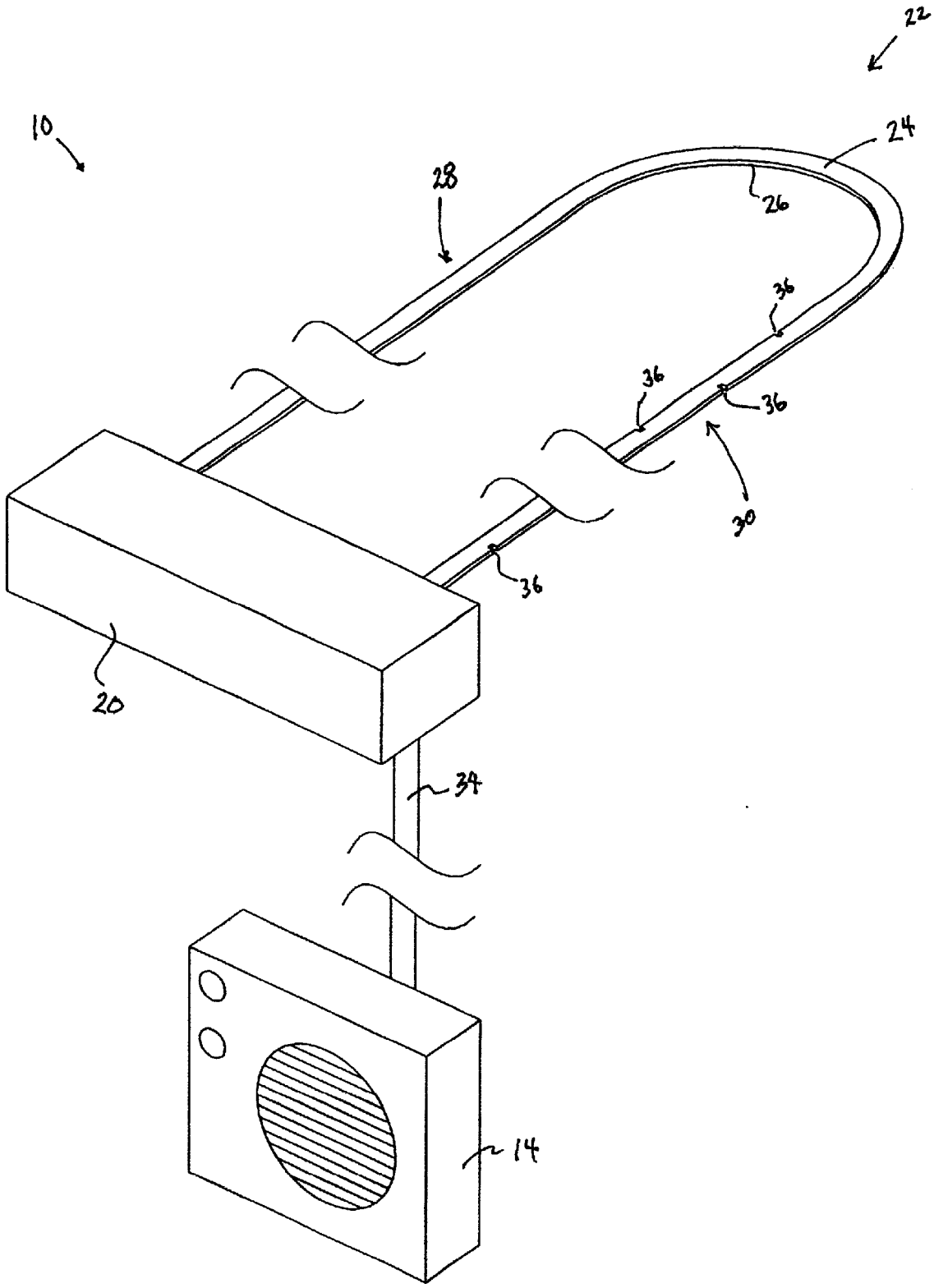
FIG. 1 is a perspective view of a fire event detection system according to the preferred embodiment of the present invention.

The system 10 further includes an elongate temperature sensor 22 coupled at its ends to a base member 20, the base member 20 preferably formed as a hollow box-shaped housing (FIG. 1). The temperature sensor 22 includes a solid, temperature sensitive material in the form of a conductive positive temperature coefficient of resistance (PTCR) polymeric tape 24 having an elongate and generally flat construction. The PTCR polymeric tape 24 is flexible and rugged such that opposed ends thereof may be coupled to the base member 20 in a generally U-shaped or loop-back configuration. The PTCR polymeric tape 24 includes opposed edges 26 that extend longitudinally. The PCTR polymeric tape 24 provides a massive increase in electrical resistance at a predetermined temperature, the transition temperature being determined by the polymeric formulation of the tape.

Figure 2:
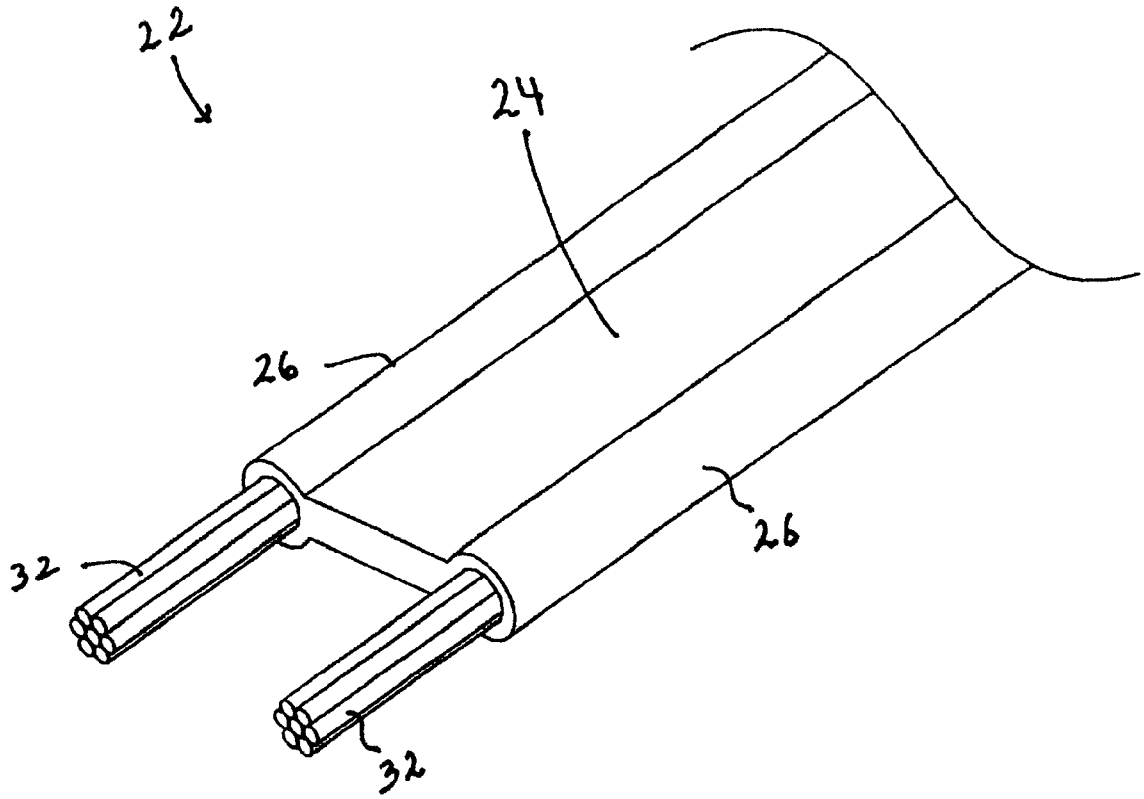
FIG. 2 is a fragmentary perspective view on an enlarged scale of one end of a PTCR polymeric tape resistance sensor of the fire event detection system as in FIG. 1.

The system 10 further includes a pair of electrical conductors 32 in the form of elongate wires that are spaced apart and extend in parallel relationship relative to one another. Each conductor 32 is enveloped by a respective edge of the PTCR polymeric tape such that the conductor 32 is in contact therewith and such that the tape 24 spans between the conductors 32 (FIG. 2). Therefore, the sensor 22, which includes the PTCR polymeric tape 24 and pair of conductors 32, may extend from the base member 20 substantially across an entire area to be monitored and then be folded back to the base member 20 (FIG. 1). The conductors 32 extend from each end of the PTCR polymeric tape 24 (FIG. 2) into the base member 20. The conductors 32 extend from the base member 20 to the housing 14 through a conduit or cable 34 and are electrically connected to the logic circuit 12 in the housing 14, whereby to deliver resistance input data from the PTCR polymeric tape 24 to the logic circuit 12. Accordingly, this arrangement allows the base member 20 and sensor 22 to be positioned in an attic and connected to the housing 14 that may be mounted in a room below the attic. It should be appreciated, however, that the base member 20 could be omitted and the sensor 22 connected directly to the housing 14 for non-attic applications.

Figure 3:
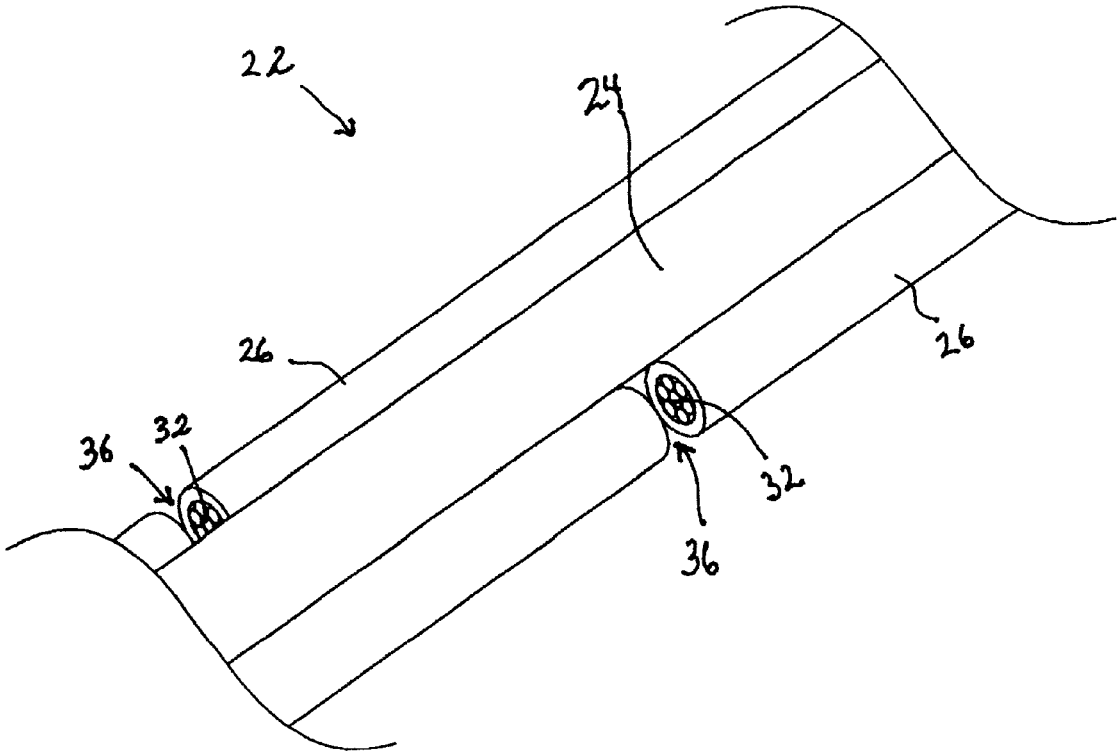
FIG. 3 is a fragmentary perspective view on an enlarged scale of a second portion of the temperature sensor of the fire event detection system as in FIG. 1.
Figure 4:
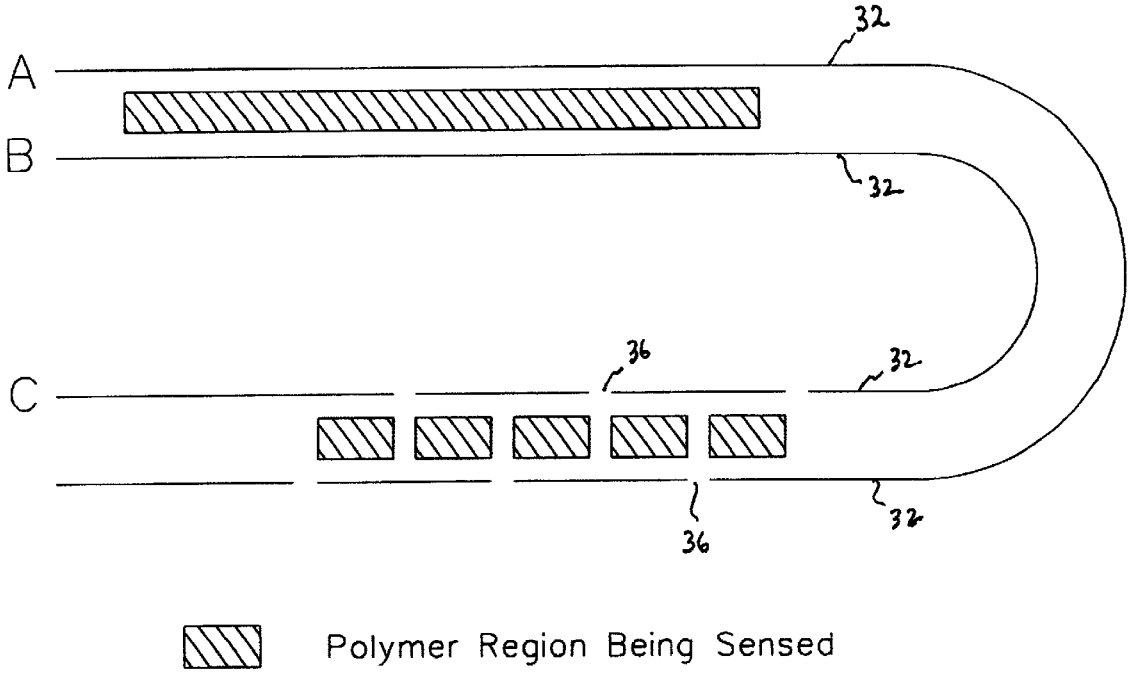
FIG. 4 is a diagrammatic view of the pair of conductors of the fire event detection system as in FIG. 1.

Preferably, the sensor 22 includes a first portion 28 and a second portion 30 having different constructions although a sensor having a single form of construction would be suitable for some applications, such as where rate of rise comparisons are not desired, as further described later. The first portion 28 of the sensor 22 is constructed as described previously and thus functions as a plurality of temperature sensing cells in a parallel configuration (FIG. 4). In the second portion 30, the edges 26 of the PTCR polymeric tape 24 and corresponding conductors 32 define a plurality of notches 36 which redirect current transversely across the tape at each notch (FIG. 3). The notches 36 are spaced apart from one another at predetermined intervals along the edges 26 and adjacent notches 36 are defined along opposed edges 26 so that current is repeatedly redirected transversely along the second portion 30. The sensitivity of the second portion to the existence of a hot spot is dependent on the spacing of the notches. This construction essentially defines a plurality of temperature sensing cells in series or, stated another way, provides a plurality of individual temperature sensors (FIG. 4).

Resistors in series are more responsive to resistance changes in any single resistor than are resistors situated in parallel. This concept may be more fully appreciated by considering an analogous example which includes a plurality of water hoses coupled in series versus a plurality of water hoses coupled in parallel. The volume of water flowing through water hoses situated in series (one after the other) would be more significantly affected when a single water hose is partially blocked than would the volume of water flowing through water hoses situated in parallel (beside each other). Therefore, changes in resistance at a single cell of the second portion 30 may be identified by the logic circuit 12 as being greater than changes to resistance relative to the first portion 28. Consequently, response to certain alarm conditions may be hastened through comparisons of the resistance changes of the first 28 and second 30 portions of the sensor 22, as to be described more fully below.

Figure 5:
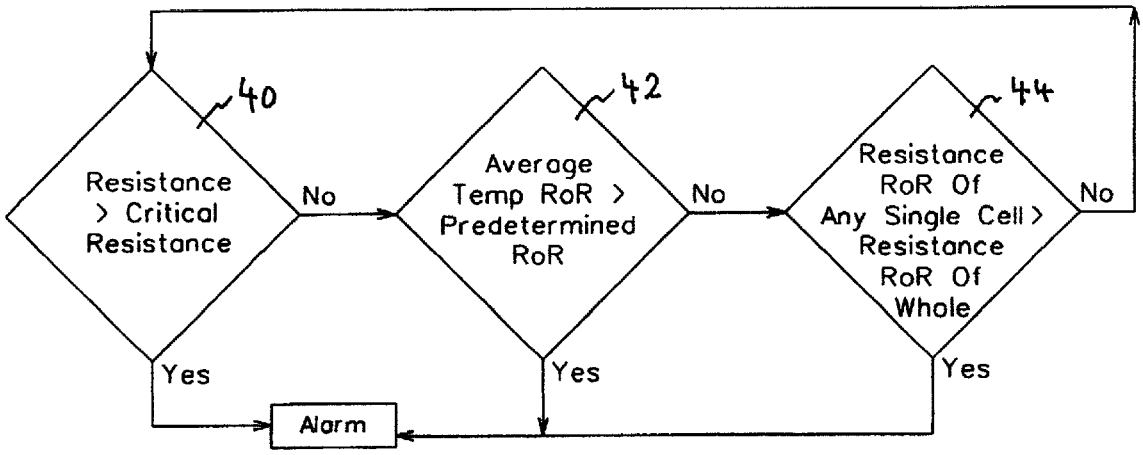
FIG. 5 is a flowchart showing the logic utilized by the programmable logic circuit.
Figure 6:
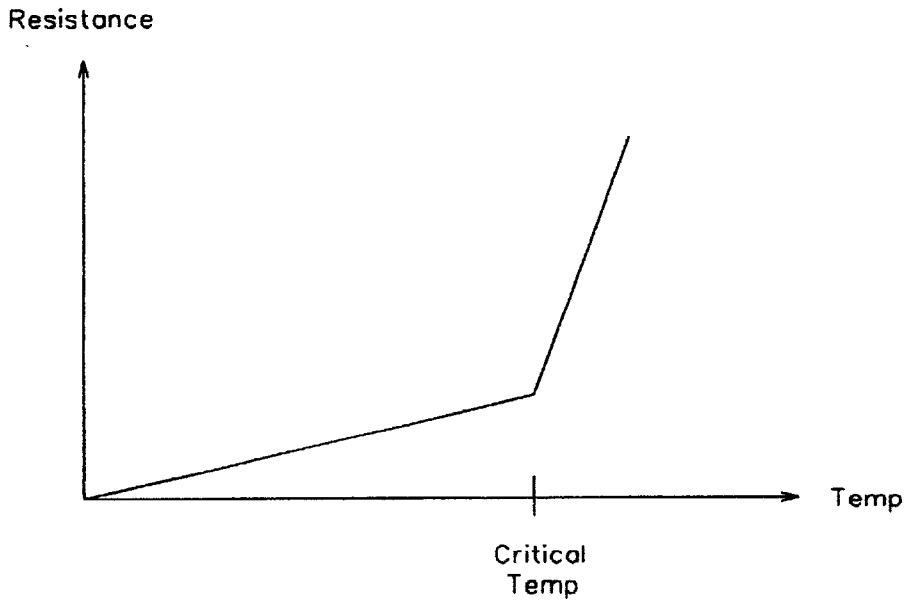
FIG. 6 is a graph illustrating how the resistance relative to the PTCR polymeric tape is affected by temperature.
Figure 7:
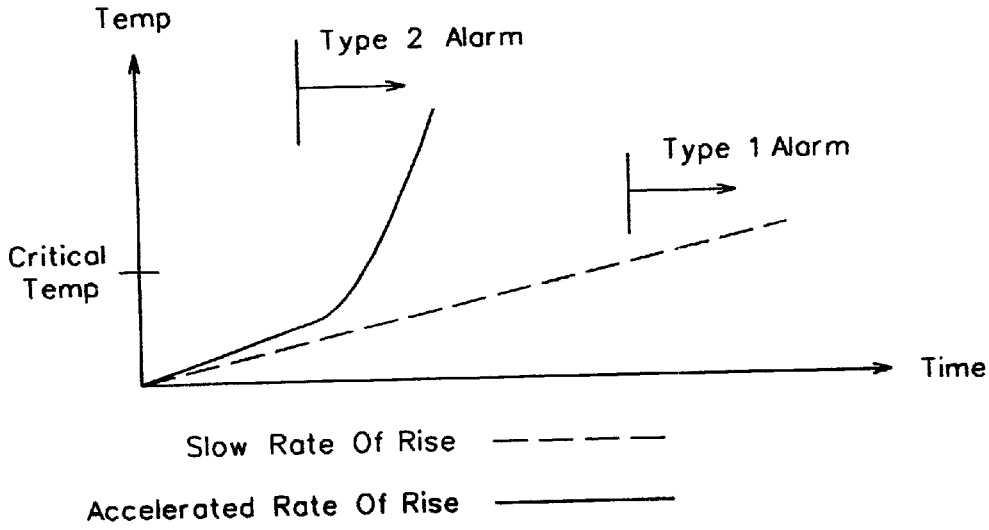
FIG. 7 is a graph illustrating types of alarm conditions relative to increases in temperature over time.

FIG. 4 is a diagrammatic view showing the pair of conductors 32 of the present system 10, the ends of which are electrically connected to the logic circuit 12. By evaluating resistance input data provided by leads A and B or by leads A and C, and by comparison with a predetermined critical resistance parameter, the logic circuit 12 can determine if a critical temperature has been reached at the second 30 portion, respectively. The circuit 12 uses the second portion data for this comparison since the series resistor configuration is more sensitive to resistance changes than is the parallel configuration. The critical temperature at which the resistance of the PTCR polymeric tape 24 dramatically increases depends on its polymeric formulation. When a critical temperature is detected 40 due to a spike in resistance (FIG. 6), the alarm 16 is energized (FIG. 5). This is a Type 1 alarm (FIG. 7). It should be appreciated that the predetermined critical temperature parameter may be quite high for attic applications so as to preclude false alarms caused by a hot attic, making the rate of rise tests of great importance as described below.

The logic circuit 12 includes a memory for storing resistance input data. Based on data stored in this memory, the logic circuit can evaluate the rate at which the temperature is rising. If evaluation of the resistance data relative to the second portion 30 indicates a temperature rate of rise that is greater than a critical temperature rate of rise parameter as indicated at block 42 in FIG. 5, then the alarm 16 is energized because such a fast temperature increase indicates a fire event as opposed to a mere climate change. This is a Type 2 alarm. As shown in FIG. 7, a type 2 alarm event may be encountered prior to a type 1 event when a critical rate of rise occurs at a temperature lower than the critical (transition) temperature.

Figure 8:
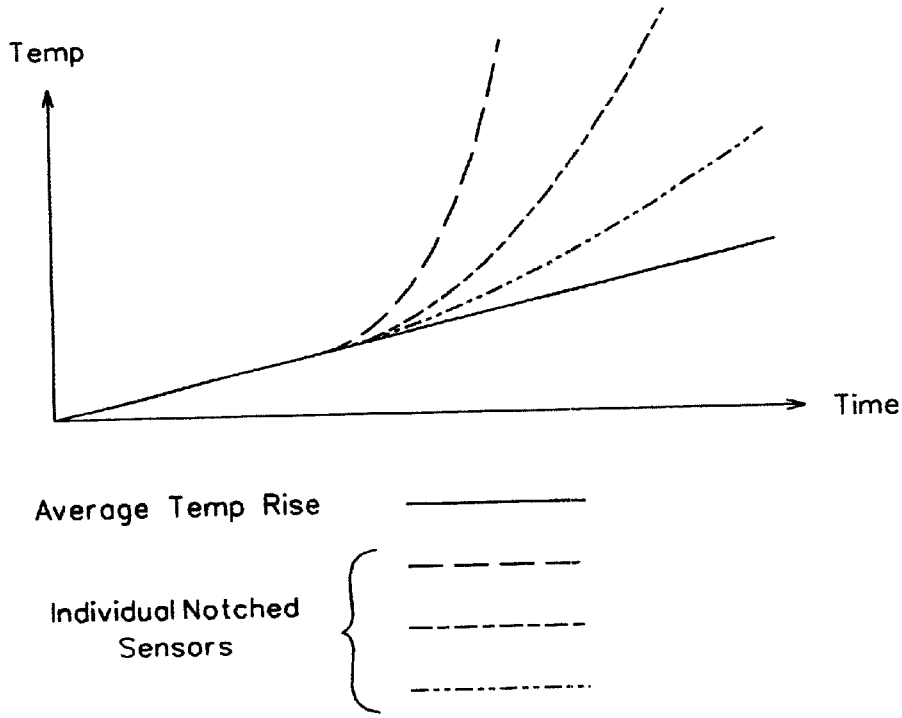
FIG. 8 is a graph illustrating how individual sensing cells may indicate temperatures different from an average temperature of the PTCR polymeric tape as a whole.

The circuit 12 is also capable of calculating and comparing the resistance rates of rise of first 28 and second 30 portions. If the resistance rate of rise of the second portion 30 is greater than that of the first portion 28 as indicated at block 44 of FIG. 5, then a hot spot is indicated and the alarm 16 is energized. This is a Type 3 alarm and is another example of how temperature changes in a single location are more rapidly identified by the series resistor portion than by the parallel resistor portion. FIG. 8 illustrates how individual cells of the second portion 30 may experience temperature rates of rise greater than that of the tape as a whole. In other words, the resistance of the first and second portions will experience the same percentage increase if the temperature of the monitoring area increases uniformly. However, the resistance rate of rise (percentage change) of the second portion 30 will increase faster than that of the first portion 28 if a hot spot is present since the second portion includes resistors in series rather than in parallel. It is understood that the type 3 test is accurate because the first and second portions of the PTCR polymeric tape 24 are configured in a U-shaped or fold-back arrangement and therefore sense the same temperature environment. Therefore, the type 2 and 3 alarm conditions illustrate how the present system 10 provides a fast response to fire event conditions even before the overall temperature reaches a critical transition temperature. This is especially important in an attic environment where the critical temperature parameter may be quite high so as not to experience a false alarm due only to hot weather.

Accordingly, the fire event detection system provides faster responses to fire events occurring within a monitoring area in that fire indicators need not progress to a single location to be sensed. Instead, the elongate polymeric sensor may extend continuously throughout the monitoring area. Further, the present system may be programmed to sound an alarm upon sensing a critical temperature, a critical temperature rate of rise, or a particular location whose resistance is increasing faster than that of the sensor as a whole.

Other embodiments of this system are also possible. While the elongate sensor 22 may be positioned within an attic or other monitoring area, it may also be installed within walls during new home construction. Use of an adhesive tape backing would make mounting the sensor to existing structures easy, economical, and aesthetically attractive. The sensor could even be wrapped about the housing of a traditional fire detector housing and connected to a logic circuit therein. Multiple elongate polymeric sensors coupled to a single logic controller for monitoring multiple rooms is also a possibility.

It is understood that while certain forms of this invention have been illustrated and described, it is not limited thereto except insofar as such limitations are included in the following claims and allowable functional equivalents thereof.

Having thus described the invention, what is claimed as new and desired to be secured by letters patent is as follows:

1. A fire event detection system, comprising:

an alarm;

a logic circuit capable of evaluating resistance input data supplied thereto, said circuit including means for generating an output signal to energize said alarm;

a pair of electrical conductors spaced apart and extending parallel to one another, each conductor electrically connected to said circuit for providing said resistance input data thereto;

a power source for said circuit and alarm;

a solid conductive PTCR polymeric tape having opposed longitudinal edges in contact with said pair of electrical conductors and spanning therebetween, said PCTR polymeric tape defining a plurality of temperature sensing cells configured in series therealong, said PTCR polymeric tape being conductive and capable of a sharp increase in electrical resistance at a predetermined temperature at any single sensing cell where said predetermined temperature occurs;

said pair of conductors providing said resistance input data to said circuit for evaluation indicative of a resistance of said PTCR polymeric tape, said circuit including means for comparing said resistance with a predetermined parameter, said circuit generating said signal for energizing said alarm if said evaluated resistance input data indicates a resistance greater than said predetermined resistance parameter.

2. The fire event detection system as in claim 1 further comprising:

said pair of conductors providing said resistance input data to said circuit for evaluation indicative of an average temperature rate of rise of at least one of said sensing cells of said PTCR polymeric tape, said circuit including means for comparing said average temperature rate of rise with a predetermined critical rate of rise parameter, said circuit generating said signal for energizing said alarm if said evaluated resistance input data indicates an average temperature rate of rise greater than said critical rate of rise parameter.

3. The fire event detection system as in claim 2 wherein said circuit includes a memory for storing said resistance input data received from said pair of conductors, said circuit including means for calculating said average temperature rate of rise using said stored resistance input data.

4. The fire event detection system as in claim 1 further comprising a housing defining an open space, said alarm, power source, and circuit being disposed in said open space.

5. The fire event detection system as in claim 4 wherein said PTCR polymeric tape includes first and second ends coupled to a base member, said PTCR polymeric tape extending from said base member in a U-shaped configuration, said pair of conductors being electrically connected to said circuit.

6. The fire event detection system as in claim 5 wherein said housing is adapted to be mounted to a wall of a dwelling and said base member is adapted to be mounted in an attic of said dwelling.

7. The fire event detection system as in claim 1 wherein said power source is a battery.

8. The fire event detection system as in claim 1 wherein said pair of conductors and said PTCR polymeric tape form an elongate and generally flat construction.

9. A fire event detection system, comprising: an alarm;

a programmable logic circuit capable of evaluating resistance input data supplied thereto, said circuit including means for generating an output signal to energize said alarm;

a pair of electrical conductors spaced apart and extending parallel to one another, each conductor having first and second ends electrically connected to said circuit for providing said resistance input data thereto;

a power source for said circuit and alarm, said power source electrically connected to said pair of electrical conductors;

a solid conductive PTCR polymeric tape having opposed longitudinal edges in contact with and enveloping said pair of electrical conductors and spanning therebetween, said PTCR polymeric tape being conductive and capable of a massive increase in electrical resistance at a predetermined temperature at any location along said PTCR polymeric tape where said predetermined temperature occurs, said PTCR polymeric tape further comprising:

a first portion defining a temperature sensing cell in parallel therealong, said first portion being capable of an increase in electrical resistance upon an increase in an average temperature thereof;

a second portion integrally connected to said first portion and defining a plurality of temperature sensing cells in series therealong, said second portion capable of an increase in electrical resistance upon an increase in an average temperature thereof;

said pair of conductors providing said resistance input data to said circuit for evaluation indicative of a resistance of said plurality of sensing cells of said second portion of said PTCR polymeric tape, said circuit including means for comparing said resistance of said sensing cells with a predetermined critical resistance parameter, said circuit generating said signal for energizing said alarm if said evaluated resistance input data relative to said second portion indicates a resistance greater than said predetermined critical resistance parameter;

said pair of conductors providing said resistance input data to said circuit for evaluation indicative of an average temperature rate of rise of said first portion and an average temperature rate of rise of said plurality of sensing cells of said second portion;

said circuit including means for comparing respective average temperature rate of rise of said second portion with a predetermined critical rate of rise parameter, said circuit generating said signal for energizing said alarm if said evaluated resistance input data relative to said second portion indicates an average temperature rate of rise greater than said critical temperature rate of rise parameter;

said pair of conductors providing said resistance input data to said circuit for evaluation indicative of resistance rates of rise of said first and second portions, respectively;

said circuit including means for comparing said resistance rate of rise of said second portion with said resistance rate of rise of said first portion, said circuit generating said signal for energizing said alarm if said resistance rate of rise of said second portion is greater than said resistance rate of rise of said first portion.

10. The fire event detection system as in claim 9 wherein said circuit includes a memory for storing said resistance input data received from said pair of conductors, said circuit including means for calculating said average temperature rate of rise using said stored resistance input data.

11. The fire event detection system as in claim 9 wherein a fire event is unambiguously indicated when said resistance rate of rise of said second portion is greater than said resistance rate of rise of said first portion.

12. The fire event detection system as in claim 10 wherein respective resistance rates of rise of said first and second portions are identical when said PTCR polymeric tape experiences a uniform temperature rate of rise and said resistance rate of rise of said second portion increases at a proportion greater than a proportionate change in said resistance rate of rise of said first portion when a particular sensing cell along said second portion experiences a temperature increase greater than a temperature increase along the rest of said PTCR polymeric tape.

13. The fire event detection system as in claim 9 wherein each edge of said second portion and a corresponding section of a respective conductor define a plurality corresponding notches therealong with each notch in one edge of said second portion being spaced apart from an adjacent notch of an opposed edge for redirecting current transversely across said PTCR polymeric tape between said opposed edges thereof, whereby to form said plurality of temperature sensing cells arranged in series.

14. The fire event detection system as in claim 9 further comprising a housing defining an open space, said alarm, power source, and circuit being disposed in said open space.

15. The fire event detection system as in claim 14 wherein said PTCR polymeric tape includes first and second ends coupled to a base member, said PTCR polymeric tape extending from said base member in a U-shaped configuration.

16. The fire event detection system as in claim 15 wherein said base member is adapted to be mounted in an attic.

17. The fire event detection system as in claim 9 wherein said power source is a battery.

18. The fire event detection system as in claim 9 wherein said pair of conductors and said PTCR polymeric tape form a generally flat, elongate construction.

19. A method for detecting a fire event, comprising:

providing a programmable logic circuit capable of evaluating electrical resistance input data supplied thereto;

providing a power source for said circuit;

providing a pair of spaced apart elongate electrical conductors having first and second ends electrically connected to said circuit for providing said resistance input data thereto;

providing a solid conductive PTCR polymeric tape having opposed longitudinal edges in contact with and enveloping said pair of electrical conductors, said PTCR polymeric tape and said conductors defining a plurality of temperature sensing cells arranged in series therealong, said PTCR polymeric tape being conductive and capable of a sharp increase in electrical resistance at a predetermined temperature at any sensing cell where said predetermined temperature occurs;

providing said resistance input data to said circuit for evaluation indicative of a temperature of said any sensing cell;

comparing said temperature with a predetermined critical temperature parameter; and generating an alarm signal if said temperature is greater than said predetermined critical temperature parameter.

20. The method as in claim 19 further comprising:

providing said resistance input data to said circuit for evaluation indicative of an average temperature rate of rise of said plurality of sensing cells;

comparing said average temperature rate of rise to a predetermined critical average temperature rate of rise parameter; and generating an alarm signal if said evaluated resistance input data indicates an average temperature rate of rise greater than said critical rate of rise parameter.

* * * * *